US010454175B2

(12) United States Patent
Petit et al.

(10) Patent No.: US 10,454,175 B2
(45) Date of Patent: Oct. 22, 2019

(54) TRANSCEIVER DEVICE AND ASSOCIATED ANTENNA

(71) Applicant: THALES, Courbevoie (FR)

(72) Inventors: Vincent Petit, Elancourt (FR); Bruno Louis, Elancourt (FR); Christian Renard, Elancourt (FR); Laurent Fedorowicz, Elancourt (FR)

(73) Assignee: Thales, Courbevoie (FR)

( * ) Notice: Subject to any disclaimer, the term of this patent is extended or adjusted under 35 U.S.C. 154(b) by 0 days.

(21) Appl. No.: 15/876,667

(22) Filed: Jan. 22, 2018

(65) Prior Publication Data

US 2018/0145413 A1 May 24, 2018

Related U.S. Application Data

(63) Continuation of application No. PCT/EP2016/068177, filed on Jul. 29, 2016.

(30) Foreign Application Priority Data

Jul. 31, 2015 (FR) ..... 15 01644

(51) Int. Cl.
*H01Q 9/04* (2006.01)
*H01Q 23/00* (2006.01)

(52) U.S. Cl.
CPC ..... *H01Q 9/0435* (2013.01); *H01Q 9/0457* (2013.01); *H01Q 9/0478* (2013.01); *H01Q 23/00* (2013.01)

(58) Field of Classification Search
CPC .. H01Q 9/0435; H01Q 9/0457; H01Q 9/0478; H01Q 23/00; H01L 2223/6683
See application file for complete search history.

(56) References Cited

U.S. PATENT DOCUMENTS 6,009,314 A * 12/1999 Bjork ..... H01P 1/15 455/83
6,466,171 B1 10/2002 Sherman et al.
(Continued)

OTHER PUBLICATIONS

International Search Report from related application PCT/EP2016/068177, dated Oct. 11, 2016.
(Continued)

*Primary Examiner* — Dameon E Levi
*Assistant Examiner* — David E Lotter
(74) *Attorney, Agent, or Firm* — Knobbe, Martens, Olson & Bear, LLP

(57) ABSTRACT

A transceiver device and associated antenna are disclosed. In one aspect, the transceiver device combines first and second transceiver modules with a transceiver capability including a substantially planar radiating element and including a central point. Each transceiver module is a transceiver module coupled with the transceiver capability so as to excite a pair of excitation points of the radiating element, the excitation points of one pair being arranged symmetrically relative to the central point of the radiating element. The first and second transceiver modules respectively excite a first pair of excitation points arranged in a first direction of the radiating element and a second pair of excitation points arranged in a second direction of the radiating element, the first and second directions being mutually orthogonal.

12 Claims, 1 Drawing Sheet

(56) References Cited

U.S. PATENT DOCUMENTS

| | | | | |
|---|---|---|---|---|
| 2005/0206568 | A1* | 9/2005 | Phillips | H01Q 9/0414 343/700 MS |
| 2012/0188917 | A1* | 7/2012 | Knox | H01Q 1/2225 370/277 |
| 2012/0295556 | A1 | 11/2012 | Chien et al. | |
| 2014/0292595 | A1* | 10/2014 | Kim | H01Q 9/045 343/720 |

OTHER PUBLICATIONS

Search Report from related application FR 1501644, dated Jun. 15, 2016.

* cited by examiner

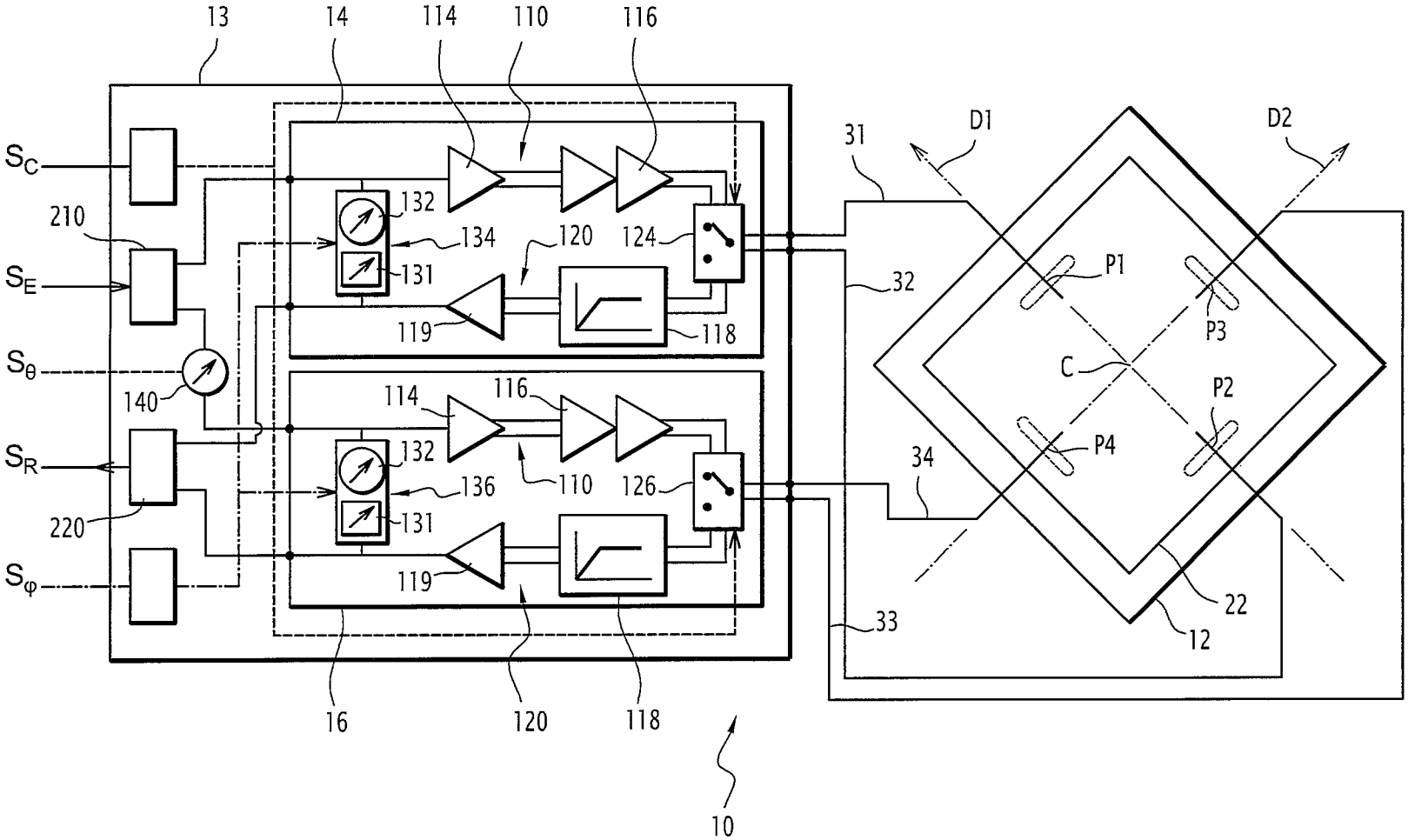
D2
D1
P1
P2
P3
P4
C
22
12
31
32
33
34
10
116
110
114
14
13
124
126
118
120
134
136
132
131
119
140
210
220
$S_C$
$S_E$
$S_\theta$
$S_R$
$S_\varphi$

TRANSCEIVER DEVICE AND ASSOCIATED ANTENNA

CROSS-REFERENCE TO RELATED APPLICATIONS

This application is a continuation of International Application No. PCT/EP2016/068177, filed Jul. 29, 2016, which claims the benefit under 35 U.S.C. § 119 of French Application No. 15 01644, filed Jul. 31, 2015, each of which is herein incorporated by reference in its entirety.

BACKGROUND

Technological Field

The subject of the present described technology is that of transceiver devices for antennas, in particular transceiver devices capable of operating in the microwave domain and with power levels compatible with radar or electronic warfare applications.

Description of the Related Technology

In a manner known per se, a radar antenna consists of a matrix of transceiver capabilities (or elementary antennas) comprising substantially planar radiating elements. Each radiating element is associated with a transceiver module (or T/R for transmission/reception module).

The transceiver module is arranged in the volume located just behind the transceiver capabilities. In transmission, the transceiver module amplifies an energizing signal, desirably a microwave signal, received from remote signal generation electronics and applies the amplified energizing signal to the transceiver capabilities. In reception, the transceiver module amplifies a reception signal received from the transceiver capabilities and transmits the amplified reception signal to remote acquisition electronics.

SUMMARY OF CERTAIN INVENTIVE ASPECTS

In the present document, the association of a transceiver capability and a transceiver module is generally referred to as a transceiver device.

In radar or electronic warfare applications, there is a need to work with high powers, both in transmission and reception.

However, available powers are limited by the properties of the technologies implemented for the transceiver module. The Monolithic Microwave Integrated Circuit (MMIC) technologies conventionally implemented are characterized by maximum available powers, beyond which it is desirable to work in the applications mentioned above.

The described technology therefore aims to overcome this problem.

Certain aspects of the described technology relate to a transceiver device associating first and second transceiver modules with a transceiver capability comprising a substantially planar radiating element and comprising a central point, wherein each transceiver module is a transceiver module coupled to the transceiver capability for energizing a pair of excitation points of the radiating element, wherein the excitation points of a pair are arranged symmetrically with respect to the central point of the radiating element, wherein the first and second transceiver modules respectively energize a first pair of excitation points arranged in a first direction of the radiating element and a second pair of excitation points arranged in a second direction of the radiating element, wherein the first and second directions are mutually orthogonal.

To operate with high powers, the described technology uses two transceiver modules coupled to dual polarization quadrature accesses of the same planar radiating element, wherein each of the modules operates at a power level that is rated compatible with the maximum power acceptable by the technology used to manufacture the power module.

In transmission, the recombination of the pair of elementary waves emitted by the radiating element where each elementary wave is energized independently of one another by each of the transceiver modules, leads to a total wave whose power is twice as large (+3 dB) as the power of each elementary wave.

In reception, the incident total wave is decomposed into two elementary waves and transmitted to each of the transceiver modules. An elementary wave has a power that is two times lower (−3 dB) than the power of the incident total wave.

According to particular embodiments, the transceiver device comprises one or more of the following characteristics, taken separately or according to all technically feasible combinations:

the first and second transceiver modules are implemented using MMIC technology.

the first and second transceiver modules are implemented on the same substrate.

the first and second transceiver modules are coupled to the transceiver capability so that the transceiver capability constitutes the same load impedance for each of the first and second transceiver modules.

the transceiver capability is a "patch" antenna, wherein the radiating element is constituted by a layer made of a conductive material, wherein each of the first and second transceiver modules is coupled to the transceiver capability by a pair of power supply lines, wherein one free end of each line is coupled to an excitation point of the radiating element.

a distance between two excitation points of a pair of excitation points of the radiating element is adjusted as a function of the impedance sought for the load constituted by the transceiver capability for the first and second transceiver modules.

the first and second transceiver modules respectively comprise a controlled switch allowing alternation of the mode of operation of the module in transmission and reception, wherein a common control signal is applied to the controlled switches of the first and second transceiver modules.

the device further comprises capability for adjusting a relative phase between the first and second energizing signals applied by the first and second modules to the transceiver capability.

each of the first and second modules comprises a phase shift capability, wherein a common phase shift signal is applied to the phase shift capability of the first and second transceiver modules.

Another object of the described technology is an antenna comprising a plurality of transceiver devices, wherein each transceiver device is in accordance with the device presented above.

BRIEF DESCRIPTION OF THE DRAWINGS

The described technology and its advantages will be better understood upon reading the following detailed description of particular embodiments, provided by way of a non-limiting example, wherein this description is provided with reference to the appended FIG. 1, which represents schematically a transceiver device according to the described technology.

DETAILED DESCRIPTION OF CERTAIN INVENTIVE EMBODIMENTS

FIG. 1 shows schematically a transceiver device 10, which comprises a transceiver capability 12 and an electronic circuit 13 integrating a first transceiver module 14 and a second transceiver module 16. The first and second modules 14 and 16 are respectively connected to the transceiver capability 12 by a pair of supply lines 31, 32 and 33, 34 respectively.

The transceiver capability 12, shown schematically in a plan view in the figure, is known by the term "patch" antenna. It comprises a substantially planar radiating element 22 arranged above a layer forming the ground plane, wherein a gap is provided between the radiating element and the ground plane layer, wherein this gap is made, for example, of an insulating material or a dielectric material. Desirably the radiating element 22 is a plate of a conductive material. It may have a square shape. Alternatively, the radiating element 22 may comprise, in addition to an energizing plate, other metal plates which are superimposed on the energizing plate. Whatever the geometry of the radiating element 22 (square, disc-shaped, etc.), it is possible to define a central point C therein.

The plane of the radiating element 22 is defined by two mutually orthogonal directions D1 and D2, wherein the first direction D1 connects the middle of two opposite sides of the square formed by the radiating element 22, while the second direction D2 connects the middle of the other two opposite sides of the square formed by the radiating element 22.

In general, the energizing of the radiating element is effected by coupling with the end of a supply line.

This coupling is made, for example, by electrically connecting the end of the supply line to an excitation point of the radiating element. For example, at the end of the supply line, the energizing current flows to the radiating element, through the insulating material placed between the radiating element and the ground planar layer, for example by means of a metallized path to connect the end of the conductive power supply line to a pin located to the right of the point to be energized at the rear of the radiating element.

Alternatively, this coupling may be achieved by a slot in the ground plane layer. The end of the supply line is arranged to overlap this slot from below, wherein the radiating element is located above the ground plane layer. The excitation point of the radiating element is then located substantially facing the center of the slot. Such a coupling is implemented in the appended figure, wherein the slots in the ground plane layer are schematically represented by dotted lines.

Other coupling variants allowing the energizing of a planar antenna are known: thus the energizing may be carried out on the plane itself of the planar radiating element, or "patch", by connecting it directly by a printed microstrip line connected to the edge of the "patch". Thus, again, the energizing may be effected by proximity coupling to a "microstrip" line printed between the "patch" and the ground plane layer.

The first and second transceiver modules 14 and 16 are identical to each other. On the one hand, they are arranged between microwave signal generation electronics and remote acquisition electronics (not shown in the figure), and, on the other hand, the transceiver capability 12.

On the downstream side, i.e. on the side of the transceiver capability, each module is connected directly to the transceiver capability 12 by a pair of power supply lines and is therefore able, in transmission, to apply a differential energizing signal and, in reception, to acquire a differential reception signal. Since a transceiver module already operates on differential signals, the fact of connecting it to a load in a differential manner avoids having to interpose a component, such as a balun (balanced unbalanced transformer) in order to pass from a differential signal to a common mode signal. Because such an intermediate component degrades the power efficiency. The power output of the device 10 is thus improved.

The first module 14 is thus coupled to the transceiver capability 12 via the supply lines 31 and 32, the free ends of which are respectively coupled to two excitation points P1 and P2 of the radiating element 22. The points P1 and P2 are arranged symmetrically on either side of the central point C of the radiating element 22 along the first direction D1.

Similarly, the second transceiver module 16 is coupled to the transceiver capability 12 via the supply lines 33 and 34, whose free ends are respectively coupled to two excitation points P3 and P4 of the radiating element 22. The points P3 and P4 are arranged symmetrically on either side of the central point C along the second direction D2.

The distance between two excitation points P1 and P2 or P3 and P4 is chosen so as to adjust the impedance of the load constituted by the transceiver capability 12 connected to the terminals of the corresponding transceiver module 14 or 16. Advantageously, the distance between the excitation points P1 and P2 and the distance between the excitation points P3 and P4 is identical so that the two modules are connected to a load of the same impedance. This distance is desirably chosen so that the impedance of the transceiver capability 12 is equal to 50 ohms. The possibility of choosing the impedance implies that it is not necessary to add a component to the device 10 in order to adapt the impedance between the transceiver modules 14 and 16, on the one hand, and the transceiver capability 12, on the other hand, by impedance transformation. This contributes to the improvement of the power output of the device 10, wherein the entire power output of a transceiver module is applied to the transceiver capability.

A transceiver module 14 and 16, comprises various conventional functions, known to persons skilled in the art.

A transceiver module thus comprises a transmission channel 110 and a reception channel 120.

In transmission, an energizing signal $S_E$ applied by the microwave signal generating electronics to the input of the circuit 13 is divided by a splitter 210 into a first energizing signal applied to the input of the transmission channel 110 of the first module 14, and a second energizing signal applied to the input of the transmission channel 110 of the second module 16. The first and second energizing signals are identical to each other, possibly to a relative phase Θ.

The transmission channel 110 comprises a capability for amplifying the energizing signal $S_E$, in particular a preamplifier 114 and a high-power amplifier 116 in the radar and electronic warfare applications.

The first and second energizing signals are respectively transmitted to the transceiver capability 12.

In reception, first and second reception signals, identical to each other and possibly at a relative phase Θ, are respectively applied by the transceiver capability 12 to the input of the reception channel 120 of the first and second transmission modules 14 and 16.

The receiving channel 120 includes a protection capability, such as a limiter 118, and an amplifier capability, such as a low noise amplifier 119.

The first and second amplified reception signals are summed by an adder 220 of the circuit 13, before the resulting reception signal is transmitted to the remote acquisition electronics.

The first module 14 comprises a switch 124 controlled by a control signal $S_C$ to switch the first module 14 either to a transmission mode of operation by connecting the transmission channel 110 to the supply lines 31 and 32, or to a reception mode by connecting the reception channel 120 to the supply lines 31 and 32.

The second module 16 comprises a switch 126 controlled by a control signal $S_C$ to switch the second module 16 either to a transmission mode of operation by connecting the transmission channel 110 to the supply lines 33 and 34, or to a reception mode by connecting the reception channel 120 to the supply lines 33 and 34.

The control signal $S_C$ applied to the controlled switch 124 of the first module 14 is also the control signal $S_C$ that is applied to the controlled switch 126 of the second module 16, so that the operating modes of the first and second modules are synchronized.

If the device 10 is intended to be integrated in an active antenna, in which the wave emitted by a radiating element is out of phase with the waves emitted by the neighboring radiating elements, so as to orient the wave plane and detune the antenna, each transceiver module integrates a phase shift capability controlled by a phase shift signal $S_\varphi$. Thus, the first module 14 comprises a first phase-shifting capability 134 while the second module 16 comprises a second phase-shifting capability 136. Each phase-shifting capability comprises, for example, an attenuator 131 and a phase-shifter 132.

In the device according to the described technology, the phase shift capability 134 and 136 of the first and second modules 12 and 16 are controlled by the same phase shift signal $S_\varphi$, so that the first and second modules 14 and 16 operate at each instant by introducing the same phase shift either on the energizing signals $S_E$ of the radiating element 22, or on the reception signals $S_R$ coming from the radiating element 22.

Advantageously, the transceiver device 10 comprises an adjustment capability 140 making it possible to introduce a relative phase Θ between the first and second energizing signals respectively applied to the input of the transmission channel 110 of each of the transceiver modules 14 and 16. As a result, the elementary waves respectively energized by the first and second modules 14 and 16 will be out of phase with each other. By recombination in this pair of elementary waves, it is then possible to generate a total wave polarized either in a vertical direction V when a relative phase of 0° is applied between the first and second energizing signals or in a horizontal direction H when a relative phase of 180° is applied; a left circular polarization when a relative phase of +90° is applied; and a right circular polarization when the relative phase is −90°. The adjustment capability 140 adjusts the value of the relative phase Θ to be introduced as a function of an adjustment signal $S_E$ received from the remote electronics.

The control signals $S_C$ with phase shift $S_\varphi$ and adjustment $S_\theta$ are emitted by the remote electronics and applied to input terminals of the circuit 13.

The first and second transmission modules 14 and 16 use MMIC technology. Desirably, SiGe technology is used, but GaAn technology could also be used. Advantageously, as shown in the figure, the first and second transceiver modules 14 and 16 are made on the same substrate so as to constitute a single circuit 13. This variant has a small footprint facilitating the integration of the circuit 13 at the rear of the transceiver capability 12.

Persons skilled in the art will find that the present transceiver device has many advantages.

The fact of energizing the radiating element by two energizing signals applied to pairs of excitation points in mutual quadrature makes it possible to symmetrize the transceiver diagram of the antenna.

As indicated above, the power of the emitted or received electromagnetic waves may be greater than the nominal operating power of each module both in transmission and in reception. The power emitted is twice as large as the nominal power. This is particularly advantageous when the nominal power is close to the maximum power allowed by the technology implemented in the transceiver modules. Although at the level of each transceiver module, the power remains below the maximum power, the device makes it possible to emit waves at a higher power.

In reception, the fact of distributing the power of the incident wave between the two transceiver modules allows the device to be more robust with respect to external aggressions, such as an illumination of the antenna by a device creating intentional or unintentional interference.

With antennas of the prior art, it is also possible to transmit a polarized total wave. This total wave may only be achieved by the combination of two linearly polarized elementary waves emitted in orthogonal directions by two neighboring radiating elements. A polarization selection switch is interposed between the transceiver module and the radiating element in order to select the direction in which the relevant element is to be energized. The polarization selection switches of two neighboring transceiver capabilities are suitably controlled so that the two elementary waves combine to obtain a total wave having the desired polarization. On the contrary, in the described technology, each radiating element is able to individually generate a polarized total wave. The point of emission of the polarized total wave coincides with the central point C of the radiating element. In addition, the fact of avoiding the use of an additional component such as a polarization selection switch further improves the efficiency of the device according to the described technology.

As indicated above, the power output of the device according to the described technology is optimized, in particular, by the possibility of directly connecting the transceiver modules to the transceiver capability. The losses are thus reduced.

As a result, the range of a radar installation is improved for two reasons:

the possibility of emitting twice as much power as achieved previously better performance in transmission and reception.

In addition, the heating of the antenna is reduced due to reduced losses.

Such a device may be used alone or in combination with other identical devices in an antenna.

As the device is particularly compact, it may be integrated into a network antenna, desirably of an electronic scanning type, as used, for example, for embedded radar applications or for ground-based electronic warfare applications. It is then adapted to operate in the microwave range, between 3 and 30 GHz with high power.

While there have been shown and described and pointed out the fundamental novel features of the invention as applied to certain inventive embodiments, it will be understood that the foregoing is considered as illustrative only of the principles of the invention and not intended to be exhaustive or to limit the invention to the precise forms disclosed. Modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplate. All such modifications and variations are within the scope of the invention as determined by the appended claims when interpreted in accordance with the breadth to which they are entitled.

What is claimed is:

1. A transceiver device, comprising:

a first transceiver module;

a second transceiver module; and a transceiver capability, the transceiver capability comprising a radiating element that is substantially planar and has a central point, wherein the first transceiver module and the second transceiver module are associated with the transceiver capability, wherein each of the first and second transceiver modules is coupled to the transceiver capability so as to excite a pair of excitation points of the radiating element, wherein the excitation points of one pair of excitation points are arranged symmetrically with respect to the central point of the radiating element, wherein the first and second transceiver modules are configured to respectively excite a first pair of excitation points arranged in a first direction of the radiating element and a second pair of excitation points arranged in a second direction of the radiating element, the first and second directions being orthogonal one with the other, and wherein the first and second transceiver modules are configured to use monolithic microwave integrated circuit (MMIC) technology and are formed on the same substrate so as to form a single circuit, the single circuit having a footprint that facilitates an integration of the single circuit at the rear of the transceiver capability.

2. The transceiver device of claim 1, wherein the first and second transceiver modules are coupled to the transceiver capability so that the transceiver capability has, for each of the first and second transceiver modules, a load of the same impedance.

3. The transceiver device of claim 1, wherein the transceiver capability comprises a patch antenna, wherein the radiating element is comprises a layer of conductive material, and wherein each of the first and second transceiver modules is coupled to the transceiver capability by a pair of power supply lines, a free end of each power supply line being coupled to one excitation point of the radiating element.

4. The transceiver device of claim 2, wherein a distance between the excitation points of one pair of excitation points of the radiating element is adapted according to the impedance sought for the load constituted by the transceiver capability for the first and second transceiver modules.

5. The transceiver device of claim 1, wherein the first and second transceiver modules respectively comprise a controlled switch, which allows an alternation of a mode of operation of the first and second transceiver module in transmission and reception, and wherein a common control signal is applied to the controlled switches of the first and second transceiver modules.

6. The transceiver device of claim 1, further comprising a capability configured to adjust a relative phase between a first energizing signal and a second energizing signal respectively applied by the first and second modules to the transceiver capability.

7. The transceiver device of claim 1, wherein each of the first and second modules comprises a phase shift capability and wherein the phase shift capability of the first and second transceiver modules is configured to receive a phase shift signal.

8. An antenna comprising a plurality of transceiver devices, wherein each transceiver device comprises:

a first transceiver module;

a second transceiver module; and a transceiver capability, the transceiver capability comprising a radiating element that is substantially planar and has a central point, wherein the first transceiver module and the second transceiver module are associated with the transceiver capability, wherein each of the first and second transceiver modules is coupled to the transceiver capability so as to excite a pair of excitation points of the radiating element, wherein the excitation points of one pair of excitation points are arranged symmetrically with respect to the central point of the radiating element, wherein the first and second transceiver modules are configured to respectively excite a first pair of excitation points arranged in a first direction of the radiating element and a second pair of excitation points arranged in a second direction of the radiating element, the first and second directions being orthogonal one with the other, and wherein the first and second transceiver modules are configured to use monolithic microwave integrated circuit (MMIC) technology and are formed on the same substrate so as to form a single circuit, the single circuit having a footprint that facilitates an integration of the single circuit at the rear of the transceiver capability.

9. The transceiver device of claim 3, wherein a coupling between the free end of each power supply line and one excitation point of the radiating element comprises a slot in a layer forming a ground plane of the transceiver capability, the end of the power supply line being arranged to overlap the slot from below, the radiating element being located above the layer forming the ground plane, and the excitation point of the radiating element being located to substantially face the center of the slot.

10. The antenna of claim 8, wherein the first and second transceiver modules of a first one of the transceiver devices are configured to use monolithic microwave integrated circuit (MMIC) technology, on the same substrate so as to form a single circuit, and the circuit being integrated at the rear of the transceiver capability of the transceiver device.

11. The antenna of claim 8, wherein, for a first one of the transceiver devices, a transmission channel of each of the first and second transceiver modules comprises a capability for amplifying an energizing signal, wherein the amplifying capability comprises a preamplifier and a high-power amplifier, and wherein a reception channel of each of the first and second transceiver modules of the first transceiver device comprises a protection capability, wherein the protection capability comprises a limiter and amplifier capability, and wherein the amplifier capability comprises a low noise amplifier (LNA).

12. The antenna of claim 8, wherein the first and second transceiver modules of a first one of the transceiver devices are located between a microwave signal generation electronics and the transceiver capability, and wherein the first and second transceiver modules of the first one of the transceiver devices are located between a remote acquisition electronics and the transceiver capability.

* * * * *